US011759665B2

(12) United States Patent
Cambria

(10) Patent No.: US 11,759,665 B2
(45) Date of Patent: Sep. 19, 2023

(54) FIREHOSE HANDLE SYSTEM

(71) Applicant: Joseph Cambria, Seaford, NY (US)

(72) Inventor: Joseph Cambria, Seaford, NY (US)

( * ) Notice: Subject to any disclaimer, the term of this patent is extended or adjusted under 35 U.S.C. 154(b) by 78 days.

(21) Appl. No.: 16/946,655

(22) Filed: Jun. 30, 2020

(65) Prior Publication Data

US 2021/0001161 A1 Jan. 7, 2021

Related U.S. Application Data

(60) Provisional application No. 62/869,845, filed on Jul. 2, 2019.

(51) Int. Cl.
*A62C 31/28* (2006.01)
*B05B 15/63* (2018.01)

(52) U.S. Cl.
CPC ..... *A62C 31/28* (2013.01); *B05B 15/63* (2018.02)

(58) Field of Classification Search
CPC ..... A62C 31/28; A62C 33/00; A62C 33/04; A62C 17/00; B05B 15/63; B05B 15/62; E01C 2019/206; E01C 2019/203; E01C 2019/2005; A01C 15/02; A01C 15/003; A01C 15/006; A01C 7/02; F16L 3/26
USPC ..... 239/273
See application file for complete search history.

(56) References Cited

U.S. PATENT DOCUMENTS

| | | | | |
|---|---|---|---|---|
| 2,848,012 | A | 8/1958 | Scott et al. | |
| 2,919,071 | A * | 12/1959 | Dalton | A62C 31/28 239/525 |
| 4,228,978 | A * | 10/1980 | Rand | E03F 1/00 138/121 |
| 4,655,492 | A | 4/1987 | Landry | |
| 4,762,257 | A | 8/1988 | Spillers et al. | |
| 4,856,834 | A | 8/1989 | Lancaster et al. | |
| 4,858,960 | A * | 8/1989 | Pharaon | A62C 33/00 285/91 |
| 5,360,168 | A | 11/1994 | McCue | |
| 5,433,288 | A | 7/1995 | James | |
| 6,003,819 | A * | 12/1999 | Hall | F16L 3/26 248/80 |
| 6,447,033 | B1 | 9/2002 | Konczak | |
| 7,070,218 | B2 | 7/2006 | Bercaw et al. | |
| 7,730,588 | B1 | 6/2010 | Bernier | |
| 8,893,355 | B2 | 11/2014 | Longley et al. | |
| 9,630,201 | B2 * | 4/2017 | Fabrey | B05B 15/63 |
| 10,486,004 | B1 | 11/2019 | Solis, Jr. et al. | |
| 2001/0030434 | A1 | 10/2001 | Uridales | |
| 2001/0050487 | A1 | 12/2001 | Uridales | |
| 2014/0232123 | A1 | 8/2014 | Lavelle et al. | |

* cited by examiner

*Primary Examiner* — Christopher R Dandridge
(74) *Attorney, Agent, or Firm* — Dunlap Bennett & Ludwig, PLLC

(57) ABSTRACT

A firehose handle device that secures to a firehose and nozzle interface. The firehose handle device has two spaced apart handles oriented transverse to the firehose/nozzle coupling when secured thereto. In certain embodiments, the handles may be selectively adjustable relative to each other.

5 Claims, 4 Drawing Sheets

FIREHOSE HANDLE SYSTEM

CROSS-REFERENCE TO RELATED APPLICATION

This application claims the benefit of priority of U.S. provisional application No. 62/869,845, filed 2 Jul. 2019, the contents of which are herein incorporated by reference.

BACKGROUND OF THE INVENTION

The present invention relates to firefighting accessories and, more particularly, an adjustable firehose handle system to operatively associate with the firehose and the nozzle to lessen the fatigue of using the firehose.

A firehose creates a great amount of back pressure during use. This back pressure fatigues a firefighter's grip, making it harder to control, maneuver and aim the nozzle of the firehose. This extra effort exacerbates an already difficult, stressful, life-and-death situation and could result in a tragedy.

The standard method of holding a hose line puts the firefighter's grip in parallel with the hose, around the circumference of the firehose, which is a suboptimal hand grip to hold and control the hose. There are one handed pistol grip nozzles however the grip is a permanent part of the nozzle, and/or non-adjustable, and puts the grip too close to the nozzle tip to maneuver effectively. Plus, only one hand is in a useful position (perpendicular or transverse to the hose), and so the other hand is parallel with the firehose (more fatiguing).

As can be seen, there is a need for an adjustable firehose handle system for operatively associating with the firehose and the nozzle to lessen the fatigue of using the firehose.

The firehose handle system of the present invention provides two selectively spaced apart handles to the rear of the nozzle, allowing both hands to be optimally spaced apart and perpendicular or transverse to the line of back pressure force, enabling the mechanical advantage of leverage in both the distance between hands and the offset from the line of force, making it easier and less fatiguing to handle the nozzle and firehose to fight a fire.

The two-hand perpendicular/transverse grip enables the muscles of the hands, arms, shoulders, chest, back, and core thus making it easy to maneuver and much less fatiguing using many muscle groups (think of solid double pistol grip rifle/shotgun stance) instead of relying on the grip strength required by the traditionally approach.

The present invention is also a non-permanent (i.e. movable) addition to most firefighting equipment.

SUMMARY OF THE INVENTION

In one aspect of the present invention, a handle device for a firehose and a nozzle operatively associated thereto including the following: a front ring dimensioned to both receive a firehose coupling portion yet not receive a nozzle coupling portion in such a way that, when coupled, said coupling portions sandwich the front ring; a framing element extending away the front ring; two spaced apart handles extending perpendicularly from the framing element; a rear ring spaced apart from the front ring, coaxial thereto, by the framing element; one or more lug slots along the rear ring, each lug slot dimensioned to slidably receive one lug of the firehose coupling portion; an inner radius of the front ring being less than an inner radius of the one or more lug slots, whereby the firehose coupling portion is entirely slidable through the rear ring but not the front ring; the framing element providing a plurality of framing connection holes; and one of the two handles having a hole connector dimensioned to removable connect to one of the plurality of framing connection holes.

In another aspect of the present invention, the handle device for a firehose and a nozzle operatively associated thereto includes the following: a front ring dimensioned to both receive a firehose coupling portion yet not receive a nozzle coupling portion a such a way that, when coupled, said coupling portions sandwich the front ring; a front framing element extending away the front ring; a front handle extending perpendicularly from the front framing element; a rear ring; a rear framing element extending away the front ring; a rear handle extending perpendicularly from the rear framing element; and each framing element having one or more frame connections holes; one or more front side bracing elements extending from the front ring; one or more rear side bracing elements extending from the rear ring; each side bracing element having one or more side connections holes; and a center support interconnects one of the framing elements and one of the one or more side bracing elements, wherein the center support has at least one side connection hole and one frame connection hole; one or more lug slots along the rear ring, each lug slot dimensioned to slidably receive one lug of the firehose coupling portion; an inner radius of the front ring being less than an inner radius of the one or more lug slots, whereby the firehose coupling portion is entirely slidable through the rear ring but not the front ring.

In yet another aspect of the present invention, method of decreasing fatigue when using a firehose further including the above-mentioned handle device and threading the firehose coupling portion through the front ring until the front ring is sandwiched against the nozzle coupling portion.

These and other features, aspects and advantages of the present invention will become better understood with reference to the following drawings, description and claims.

DETAILED DESCRIPTION OF THE INVENTION

Figure 1:
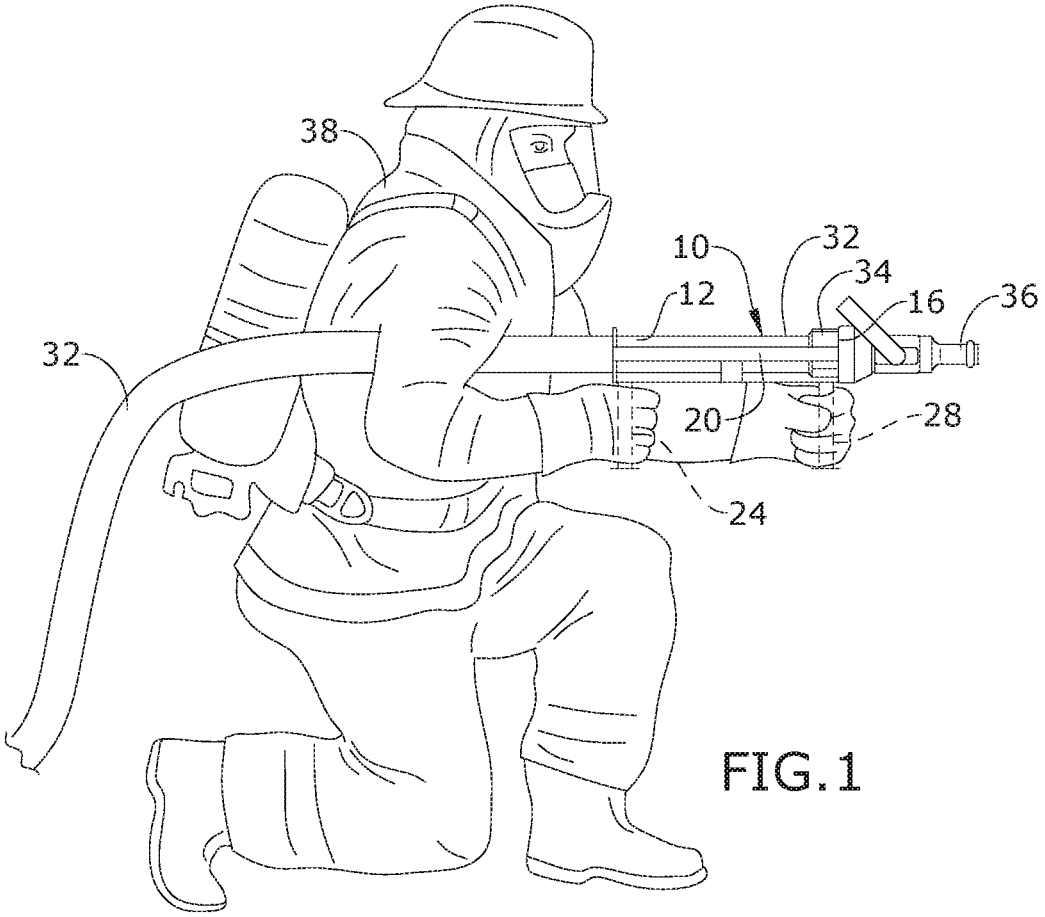
FIG. 1 is a side view of an exemplary embodiment of the present invention, shown in use.
Figure 2:
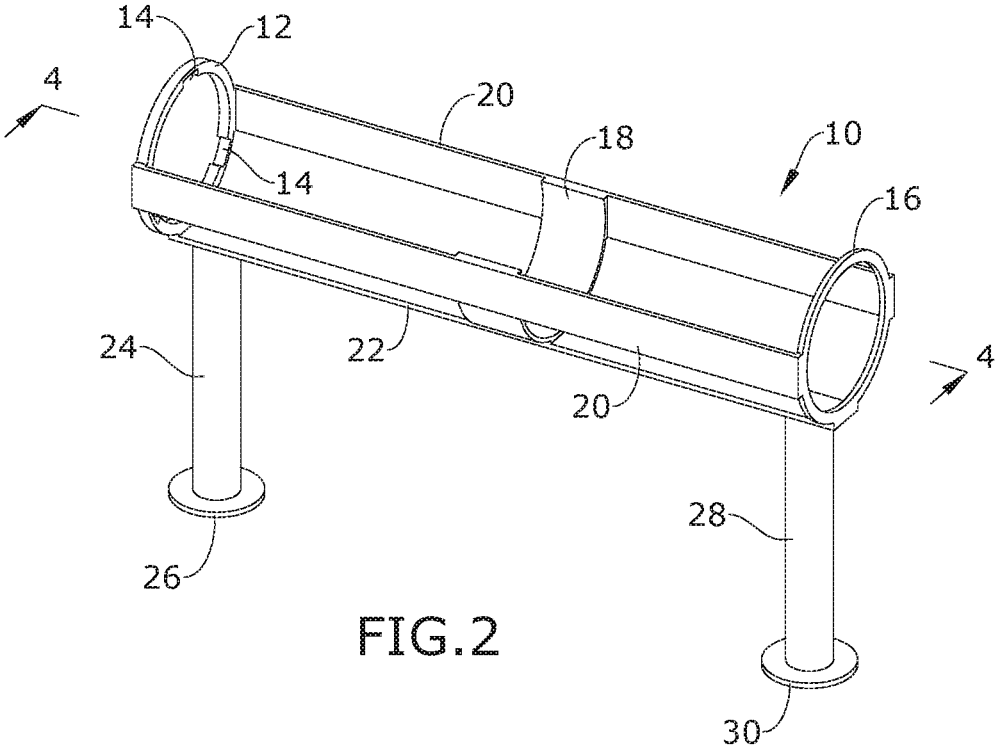
FIG. 2 is a top front perspective view of an exemplary embodiment of the present invention.
Figure 3:
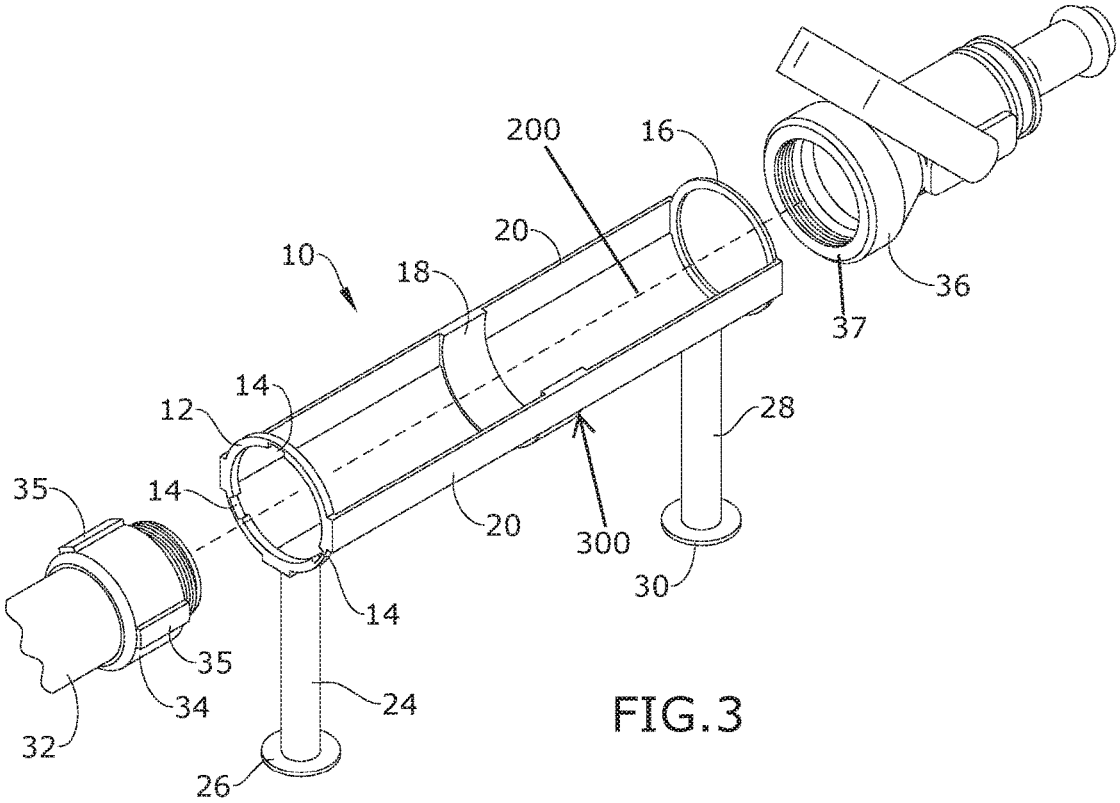
FIG. 3 is a top rear perspective view of an exemplary embodiment of the present invention, illustrating the insertion of the nozzle coupling 34 and firehose 32 into the firehose handle system before securing the nozzle 36 to nozzle coupling 34, thereby securing the firehose handle system 10 to the firehose 32 and nozzle 36.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a firehose handle device that secures to a firehose and nozzle interface. The firehose handle device has two spaced apart handles oriented perpendicular to the firehose/nozzle coupling when secured thereto. In certain embodiments, the handles may be selectively adjustable relative to each other.

Referring now to FIGS. 1 through 11, the present invention may include a firehose handle device 10 having two selectively spaced apart handles 24/68/90/116 and 28/50/94/118 in a perpendicular orientation relative to a longitudinal axis 200 of a firehose 32 and operatively associated nozzle 36. The rear handle 24/68/90/116 and the front handle 28/50/94/118 are coupled to a front ring 16/42/82/108 by a frame assembly 300. The frame assembly 300 may include a framing element 22/48/88/114 extending from the front ring 16/42/82/108 to a rear ring 12/56/78/104. Side bracing 20/86/112 may also extend between said front and rear rings 16/42/82/108 and 12/56/78/104. Furthermore, a center support 18/45/84/110 may join the framing element 22/48/88/114 and the side bracing 20/86/112. The rear handle 24/68/90/116 and the front handle 28/50/94/118 connect to the framing element 22/48/88/114. The rear handle 24/68/90/116 and the front handle 28/50/94/118 may provide feet 26/70/92 and 30/52/96, respectively.

The frame assembly 300, may as a function of the framing element 22/48/88/114 and side bracing 20/86/112 connected along a periphery of said front and rear rings 16/42/82/108 and 12/56/78/104, define a cylindrical space or possibly a cone space (if one of the rings has a greater outer diameter than the other ring). The side bracing 20/86/112 and framing element 22/48/88/114 give the frame assembly 300 a skeletal configuration. The skeletal configuration and the cylindrical space enable the firehose 32 and its nozzle coupling 34 to slide from and through the rear ring 12/56/78/104 to the front ring 16/42/82/108. Furthermore, the rear ring 12/56/78/104 may provide lug slots 14/58/80/106 dimensioned to accommodate nozzle coupling lugs 35 during this engagement process.

Figure 4:
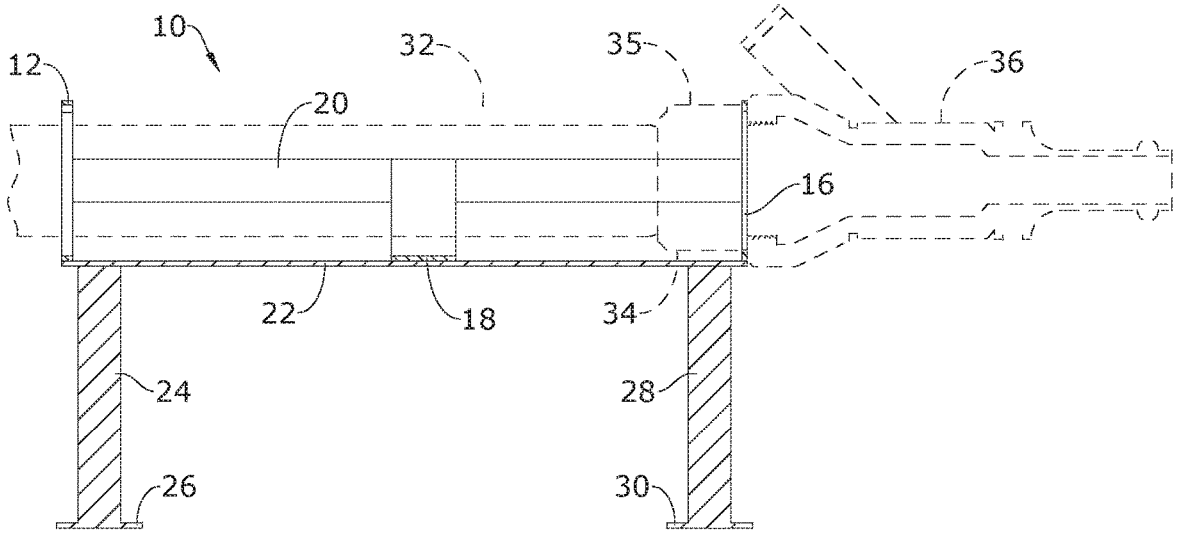
FIG. 4 is a section view of an exemplary embodiment of the present invention, taken along line 4-4 in FIG. 2 with the firehose 32, nozzle 36, and nozzle coupling 34 shown in hidden lines for reference.

The engagement process further includes a distal face of the nozzle coupling 34 sandwiching the front ring 16/42/82/108 against a proximal face 37 of the nozzle 36 when the nozzle coupling 34 operatively associates with the nozzle 36. This mechanically sandwich of the front ring and passage through the rear ring, makes slipping of the handle position nearly impossible. In certain embodiments, the front ring 16/42/82/108 may be dimensioned and adapted to be sandwiched by the distal face of the nozzle coupling 34 and/or lugs 35, as illustrated in FIG. 4. In certain embodiment, the front ring 16/42/82/108 provides sandwiching structure where the lug slots 14/58/80/106 of the rear ring 12/56/78/104 do not. In some embodiments, an inner radius of the front ring 16/42/82/108 is less than the outer radius of the lug slots 14/58/80/106 the coaxial rear ring 12/56/78/104 so that the distal face of the nozzle coupling lugs 35 pass through the rear ring 12/56/78/104 but not the front ring 16/42/82/108, and thus the "sandwiching structure". It should be understood that the radius is measured from the longitudinal axis 300, and that the inner radius define voids that which the nozzle coupling 34 and/or lugs 35 can slide through.

Figure 5:
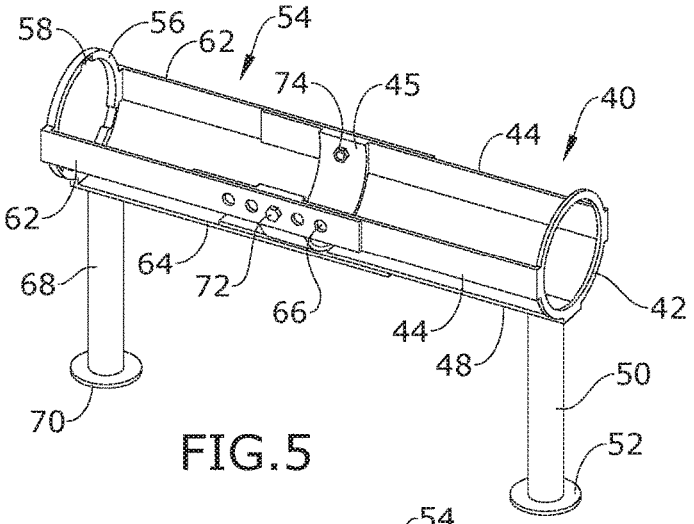
FIG. 5 is a perspective view of an exemplary embodiment of the present invention.
Figure 6:
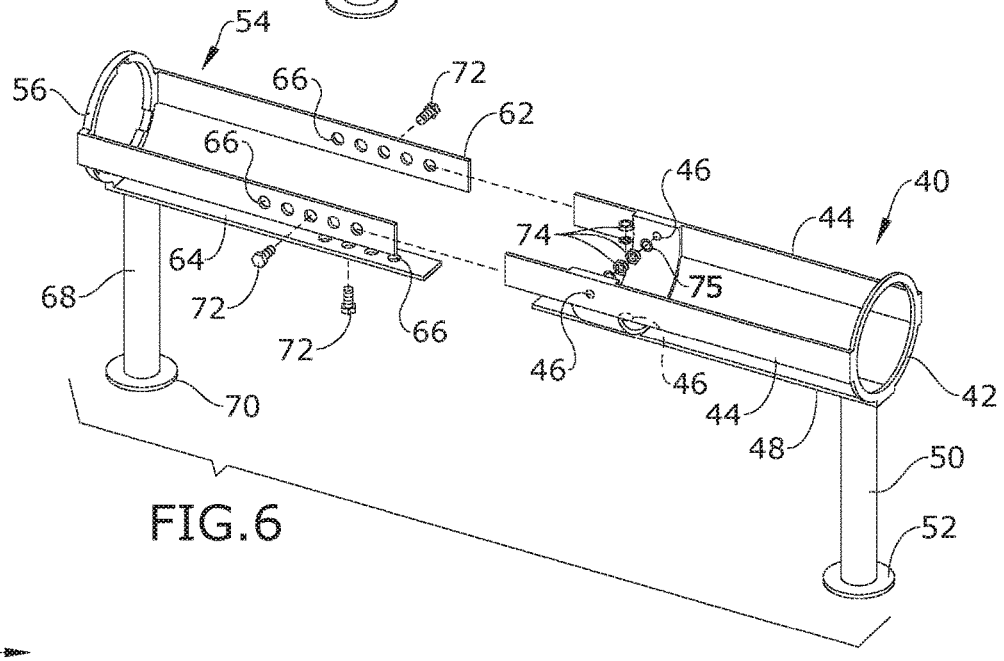
FIG. 6 is an exploded perspective view of an exemplary embodiment of the present invention.
Figure 7:
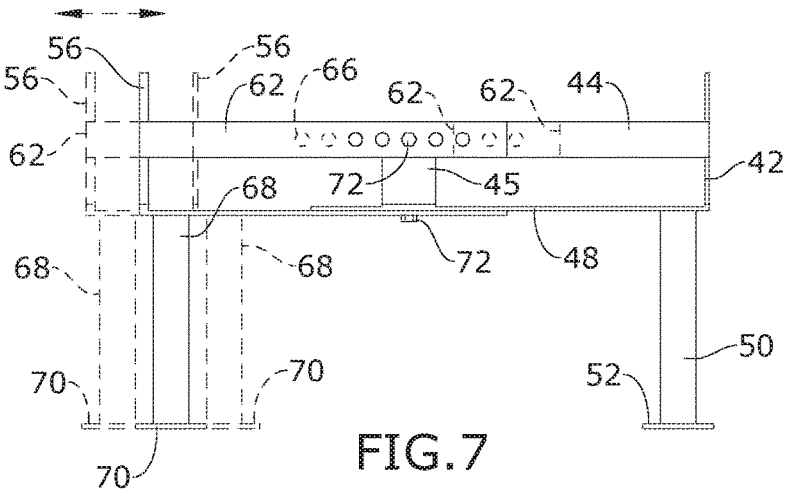
FIG. 7 is a side view of an exemplary embodiment of the present invention, illustrating the adjustment of the length of the adjustable frame assembly.

Referring to FIGS. 5-7, another embodiment of the present invention may be embodied in an adjustable firehose handle device having a front section 40 movable relative to a rear section 54. As a result, there is a front and rear side bracing 44 and 62 and a front and rear framing element 48 and 64, respectively.

A plurality of spaced apart connection holes 66 may be provided in both the framing element 64 or 48 and in the side bracing 62 or 44 and, complementarily, one or more connection hole 46 in the other sections 40 or 54 framing element and side bracing. Typically, the one or more complementary connection hole 46 will be disposed in the center support 45 for additional shear resistance and other reinforcement when fasteners 72, 74 and 75 engage the connection holes 66 and complementary connection holes 46.

Figure 8:
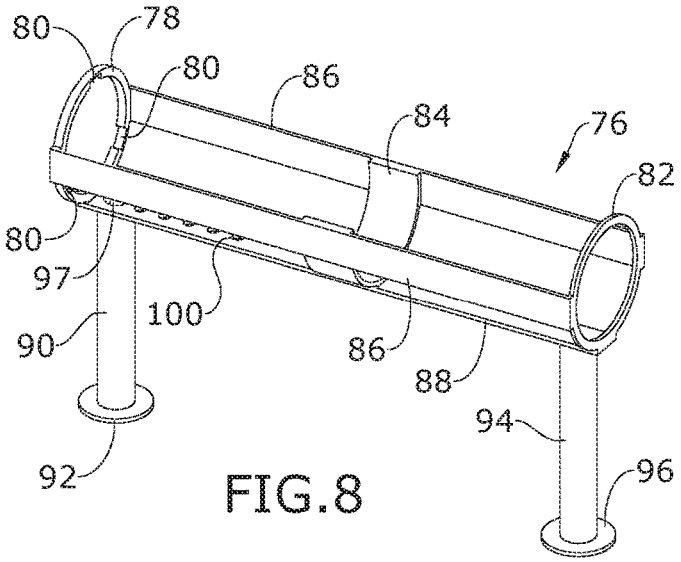
FIG. 8 is a perspective view of an exemplary embodiment of the present invention.
Figure 9:
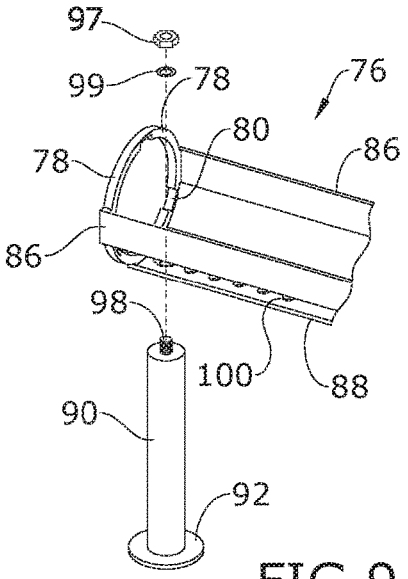
FIG. 9 is an exploded perspective view of an exemplary embodiment of the present invention.
Figure 10:
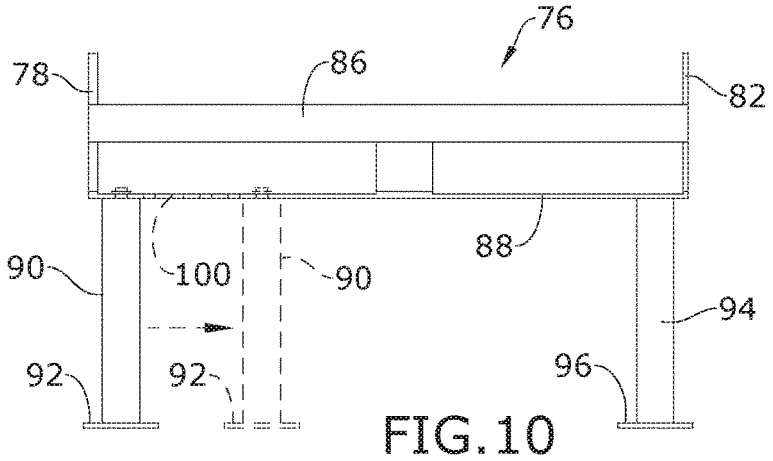
FIG. 10 is a side view of an exemplary embodiment of the present invention, illustrating the adjustment of the movable handle 90.
Figure 11:
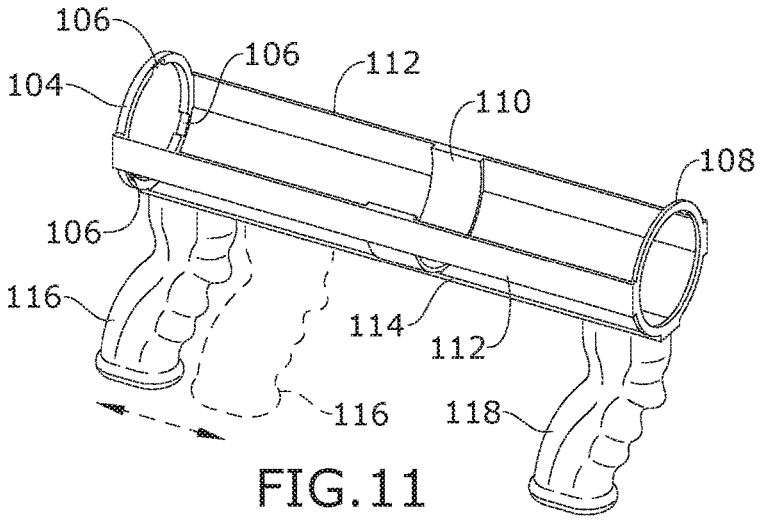
FIG. 11 is a perspective view of an exemplary embodiment of the present invention, illustrating the adjustment of the movable, contoured handles.

Referring to FIGS. 8-10, another embodiment of the present invention may be embodied in an adjustable firehose handle device 76 having one or more movable handles 90 and or 94, where each movable handle has a handle connector 98 (such as a threaded post) to engage one of a plurality of spaced apart attachment holes 100 and be secured thereto by way of fasteners 97 and 99.

A method of using the present invention may include the following. The frame assembly 300 may be provided. A user 38 may load/thread the firehose 32 through the rear ring until the nozzle coupling 34 sandwiches the front ring to the nozzle 36, removably securing the frame assembly to the firehose 32 and nozzle 36.

Moreover, the present invention does not change the way a firefighter sets up to fight a fire. The device can be attached to the firehose in the fire engine's hose bed. The firefighter would pull the hose into the affected area of the fire and fight in a position conducive to putting out the fire whether that be low on one knee or standing. The firefighter would grab the handles release one hand to open the nozzle and flow water, then take the grip again and start maneuvering the nozzle to put out the flames. These are the same steps used without the bracket; however, the bracket offers much more control and less fatigue as stated above. In short, there is little to no retraining to use the present invention, which can be very important as its use is almost always during a potentially fatal emergency.

Additionally, any industry/field that uses a hose to apply liquid/powder that has to be controlled be a human (i.e. industrial spraying of insecticide, high volume seeding, etc.) would benefit from this same type bracket/handle.

It should be understood, of course, that the foregoing relates to exemplary embodiments of the invention and that modifications may be made without departing from the spirit and scope of the invention as set forth in the following claims.

What is claimed is:

1. A handle device for a firehose and a nozzle operatively associated thereto, comprising:

a front ring dimensioned to both receive a coupling portion of a firehose coupling portion yet not receive a nozzle coupling portion a such a way that, when coupled, said coupling portions sandwich the front ring;

a front framing element extending away from the front ring;

a front handle extending transversely from the front framing element;

a rear ring;

a rear framing element extending away from the rear ring;

a rear handle extending transversely from the rear framing element;

the rear framing element having four or more frame connections holes linearly spaced apart;

two front side bracing elements extending from the front ring;

two rear side bracing elements extending from the rear ring;

the rear side bracing element having four or more side connections holes; and a center support interconnects the front framing element and the two side bracing elements, wherein the center support has two opposing center side connection hole and one center frame connection hole, wherein the holes of the center support are dimensioned and spaced apart to simultaneously engage one of the four or more frame connection holes and one of the four or more side connections holes for each side bracing element so that the rear framing element is selectively adjustable relative to the front framing element.

2. The handle device of claim 1, further comprising:

one or more lug slots along the rear ring, each lug slot dimensioned to slidably receive one lug of the firehose coupling portion.

3. The handle device of claim 2, further comprising:

an inner radius of the front ring being less than an inner radius of the one or more lug slots, whereby the firehose coupling portion is entirely slidable through the rear ring but not the front ring.

4. A method of decreasing fatigue when using a firehose, comprising:

providing the handle device of claim 1; and threading the firehose coupling portion through the front ring until the front ring is sandwiched against the nozzle coupling portion.

5. The handle device of claim 1, wherein the two side bracing elements are radially spaced apart from the front and rear elements, respectively, forming a skeletal configuration for facilitating adjustment of the front and rear framing elements relative to each other.

* * * * *